US005340465A

United States Patent [19]

Gillespie et al.

[11] Patent Number: 5,340,465

[45] Date of Patent: Aug. 23, 1994

[54] USE OF A METAL OXIDE SOLID SOLUTION FOR SWEETENING A SOUR HYDROCARBON FRACTION

[75] Inventors: Ralph D. Gillespie, Elgin; Jennifer S. Holmgren, Bloomingdale, both of Ill.

[73] Assignee: UOP, Des Plaines, Ill.

[21] Appl. No.: 136,056

[22] Filed: Oct. 14, 1993

[51] Int. Cl.[5] ..... C10G 27/04; C10G 19/073; C10G 29/16

[52] U.S. Cl. ..... 208/191; 208/206; 208/207

[58] Field of Search ..... 208/206, 207, 291 R, 208/189, 191, 143, 419, 435, 192, 191, 206, 207

*Primary Examiner*—Helen M. S. Sneed
*Assistant Examiner*—Bekir L. Yildirim
*Attorney, Agent, or Firm*—Thomas K. McBride; Eugene I. Snyder; Frank S. Milinaro

[57] ABSTRACT

An improved process for treating a sour hydrocarbon stream has been developed. This process involves contacting the sour hydrocarbon fraction with a metal oxide solid solution in the presence of an oxidizing agent such as air or oxygen. One example of a solid solution which can be used is a nickel oxide/magnesium oxide/aluminum oxide solid solution.

9 Claims, No Drawings

USE OF A METAL OXIDE SOLID SOLUTION FOR SWEETENING A SOUR HYDROCARBON FRACTION

FIELD OF THE INVENTION

This invention deals with a process for sweetening a sour hydrocarbon fraction. The process involves contacting a sour hydrocarbon fraction that contains mercaptans with a metal oxide solid solution in the presence of air or oxygen thereby converting the mercaptans to disulfides.

BACKGROUND OF THE INVENTION

Processes for the treatment of a sour hydrocarbon fraction where the fraction is treated by contacting it with an oxidation catalyst and an alkaline agent in the presence of an oxidizing agent at reaction conditions have become well known and widely practiced in the petroleum refining industry. These processes are typically designed to effect the oxidation of offensive mercaptans contained in a sour hydrocarbon fraction to innocuous disulfides—a process commonly referred to as sweetening. The oxidizing agent is most often air. Gasoline, including natural, straight run and cracked gasolines, is the most frequently treated sour hydrocarbon fraction. Other sour hydrocarbon fractions which can be treated include the normally gaseous petroleum fractions as well as naphtha, kerosene, jet fuel, fuel oil, and the like.

A commonly used continuous process for treating sour hydrocarbon fractions entails contacting the fraction with a metal phthalocyanine catalyst dispersed in an aqueous caustic solution to yield a doctor sweet product. Doctor sweet means a mercaptan content in the product low enough to test "sweet" (as opposed to "sour") by the well known doctor test. The sour fraction and the catalyst containing aqueous caustic solution provide a liquid-liquid system wherein mercaptans are converted to disulfides at the interface of the immiscible solutions in the presence of an oxidizing agent-usually air. Sour hydrocarbon fractions containing more difficult to oxidize mercaptans are more effectively treated in contact with a metal chelate catalyst dispersed on a high surface area adsorptive support-usually a metal phthalocyanine on an activated charcoal. The fraction is treated by contacting it with the supported metal chelate catalyst at oxidation conditions in the presence of a soluble alkaline agent. One such process is described in U.S. Pat. No. 2,988,500. The oxidizing agent is most often air admixed with the fraction to be treated, and the alkaline agent is most often an aqueous caustic solution charged continuously to the process or intermittently as required to maintain the catalyst in the caustic-wetted state.

The prior art shows that alkaline agents are necessary in order to catalytically oxidize mercaptans to disulfides. Thus, U.S. Pat. Nos. 3,108,081 and 4,156,641 disclose the use of alkali hydroxides especially sodium hydroxide for oxidizing mercaptans. Further, U.S. Pat. No. 4,913,802 discloses the use of ammonium hydroxide as the basic agent. The activity of the metal chelate systems can be improved by the use of quaternary ammonium compound as disclosed in U.S. Pat. Nos. 4,290,913 and 4,337,147.

It is also known that materials such as layered double hydroxides (LDH) or metal oxides solid solutions can be used as solid bases on which can be dispersed a metal chelate. These materials are described in U.S. Pat. No. 5,232,887. This patent discloses the use of a solid solution of magnesium oxide and aluminum oxide as well as an LDH identified as hydrotalcite and having the formula $$Mg_6Al_2(OH)_{16}(CO_3)\cdot 4H_2O$$

as solid bases. In order to obtain appreciable conversion of mercaptans to disulfides a polar compound such as water or methanol must be added.

In *Catalysis Letters*, 11, pp. 55–62 (1991), the authors describe the oxidation of 1-decanethiol in water using an LDH in which cobalt phthalocyanine is intercalated between the LDH layers. The process also uses a borate buffer to maintain the pH at 9.25.

In contrast to this art, applicants have discovered that solid solutions of metal oxides can catalyze the oxidation of mercaptans found in hydrocarbon fractions without the use of metal chelates or polar compounds or additional bases. The conditions necessary for oxidizing the mercaptans, i.e., sweetening the hydrocarbon fraction, are the same as those used in conventional sweetening processes. Thus, the instant process has the advantage that it does not introduce anything into the hydrocarbon stream which must later be removed.

SUMMARY OF THE INVENTION

As stated, this invention relates to a process for treating a sour hydrocarbon fraction containing mercaptans. Accordingly, one embodiment of the invention is a process for treating a sour hydrocarbon fraction containing mercaptans comprising contacting the hydrocarbon fraction with a catalyst effective in oxidizing mercaptans in the presence of an oxidizing agent under treating conditions thereby oxidizing the mercaptans to disulfides, the catalyst characterized in that it comprises a solid solution having the formula $$M_a(II)M_b(III)O_{(a+b)}(OH)_b$$

where M(II) is at least one metal having a +2 oxidation state and selected from the group consisting of magnesium, nickel, zinc, copper, iron, cobalt, calcium and mixtures thereof, M(III) is at least one metal having a +3 oxidation state and is selected from the group consisting of aluminum, chromium, gallium, scandium, iron, lanthanum, cerium, yttrium, boron and mixtures thereof, and the ratio of a:b is greater than 1 to about 15.

Other objects and embodiments of this invention will become apparent in the following detailed description.

DETAILED DESCRIPTION OF THE INVENTION

As stated, this invention relates to a process for treating a sour hydrocarbon fraction containing mercaptans. The process involves contacting the hydrocarbon fraction with a solid solution of metal oxides in the presence of an oxidizing agent.

Thus, one necessary component of this invention is a solid solution of metal oxides. These solid solutions are described by the formula $$M_a(II)M_b(III)O_{(a+b)}(OH)_b$$

where M(II) is at least one metal having a +2 oxidation state and selected from the group consisting of magnesium, nickel, zinc, copper, iron, cobalt, calcium and mixtures thereof, M(III) is at least one metal having a +3 oxidation state and is selected from the group consisting of aluminum, chromium, gallium, scandium, iron, lanthanum, cerium, yttrium, boron and mixtures thereof, and the ratio of a:b is greater than 1 to about 15. When M(II) is a mixture of two metals, the relative amount of each metal can range from 1 to 99 weight percent of the M(II) metal. That is, if M 1 and M2 represent the two metals making up M(II), then M1 and M2 can vary from 1 to 99 weight percent of the amount of M(II) in the composition. Preferred solid solutions are Mg/Al oxides and Ni/Mg/Al oxides solid solution.

These solid solutions are prepared by heating the corresponding layered double hydroxide (LDH) material at a temperature of about 300° to about 750° C. Layered double hydroxides (LDH) are basic materials that have the formula $$M_a(II)M_b(III)(OH)_{(2a+2b)}(X^{-n})_{b/n}\bullet zH_2O$$

The M(II) and M(III) metals are the same as those described for the solid solution. The values of a and b are also as set forth above. X is an anion selected from the group consisting of carbonate, nitrate, and mixtures thereof, where n is the charge on the anion. Finally, z varies from about 1 to about 50 and preferably from about 1 to about 15. These materials are referred to as layered double hydroxides because they are composed of octahedral layers, i.e., the metal cations are octahedrally surrounded by hydroxyl groups. These octahedra share edges to form infinite sheets. Interstitial anions such as carbonate are present to balance the positive charge in the octahedral layers. The preparation of layered double hydroxides is well known in the art and can be exemplified by the preparation of a nickel/magnesium/aluminum layered double hydroxide. This LDH can be prepared by coprecipitation of nickel, magnesium and aluminum carbonates at a high pH. Nickel nitrate, magnesium nitrate and aluminum nitrate (in the desired ratios) are added to an aqueous solution containing sodium hydroxide and sodium carbonate. The resultant slurry is heated at about 65° C. to crystallize the compound and then the powder is isolated and dried. Extensive details for the preparation of various LDH materials may be found in *J. Catalysis,* 94, 547–557 (1985).

As stated the LDH material is heated at a temperature of about 300° to about 750° C. to give the corresponding solid solution. The resultant solid solution is in the form of a powder which can be further processed by conventional means to form extrudates, spheres, pills, etc.

The catalyst of this invention may optionally contain a secondary component selected from the group consisting of calcium oxide, magnesium hydroxide, magnesium oxide, calcium hydroxide and mixtures thereof. The secondary component can be combined with the solid base in an amount varying from about 0.1 to about 50 weight percent of the catalyst.

Another necessary component of the instant process is an oxidizing agent. The oxidizing agent can be air, oxygen or other oxygen containing gases with air being preferred. The sour hydrocarbon fraction may contain sufficient entrained air, but generally added air is admixed with the fraction and charged to the treating zone concurrently therewith. In some cases, it may be advantageous to charge the air separately to the treating zone and countercurrent to the fraction separately charged thereto.

The treating conditions, i.e., sweetening or mercaptan oxidation conditions, and specific methods used to carry out the present invention are those that have been disclosed in the prior art. Typically, the sour hydrocarbon fraction is contacted with the catalyst which is in the form of a fixed bed. The contacting is thus carried out in a continuous manner and the hydrocarbon fraction may be flowed upwardly or downwardly through the catalytic composite. The process is usually effected at ambient temperature conditions, although higher temperatures up to about 105° C. are suitably employed. Pressures of up to about 1,000 psi or more are operable although atmospheric or substantially atmospheric pressures are suitable. Contact times equivalent to a liquid hourly space velocity of from about 0.5 to about 50 $hr^{-1}$ or more are effective to achieve a desired reduction in the mercaptan content of a sour hydrocarbon fraction, an optimum contact time being dependent on the size of the treating zone, the quantity of catalyst contained therein, and the character of the fraction being treated. Examples of specific arrangements to carry out the treating process may be found in U.S. Pat. Nos. 4,490,246 and 4,753,722 which are incorporated by reference.

It may also be desirable to add a polar compound to the hydrocarbon feed. The polar compound may be water or an alcohol such as methanol, ethanol, propanol, etc. The amount of polar compound which is added can vary from about 10 ppm to about 15,000 ppm based on hydrocarbon.

The following examples are presented in illustration of this invention and are not intended as undue limitations on the generally broad scope of the invention as set out in the appended claims.

EXAMPLE 1

Preparation of $NiO/MgO/Al_3$ Solid Solution

A 2L, 3-necked round bottomed flask was equipped with a reflux condenser, a thermometer, and a mechanical stirrer. To this flask there was added a solution containing 585 g of water, 60 g of $Na_2CO_3\bullet H_2O$ and 71 g of NaOH and the flask was cooled to <5° C. An addition funnel containing 378 g water, 32.5 g of $Mg(NO_3)_2\bullet 6H_2O$, 110 g of $Ni(NO_3)_2\bullet 6H_2O$, and 93 g $Al(NO_2)_3\bullet 9H_2O$ was put in place of the reflux condensor and the solution added to the solution in the flask over a four(4) hour period while maintaining the temperature at <5° C. The resultant slurry was stirred for 1 hour at <5° C. after which the funnel was removed and the reflux condenser replaced. The flask was now placed in a Glass Col ® heating mantle and was heated to 60° C. ±5° for 1 hour. The slurry was then cooled to room temperature, the solids recovered by filtration and washed with 10L of deionized water. These solids were then dried at 100° C. for 16 hours. After crushing the solid was calcined at 450° C. for 12 hours in a muffle furnace with air flow. X-ray diffraction analysis showed this product to be a solid solution of nickel, magnesium and aluminum oxides. This sample had a B.E.T. surface area of 199 $m^2/g$ and was identified as sample A.

EXAMPLE 2

A reactor was loaded with 20 cc of sample A and heated to 38° C. Over this catalyst there was flowed n-hexane containing 7,000 ppm water and 290 ppm (as sulfur) of thiophenol at a liquid hourly space velocity of 1.2 $hr^{-1}$. Air was injected to give a ratio of two times the stoichiometric amount required to oxidize the mercaptan to disulfide. The test was conducted for 48 hours during which time samples were withdrawn and analyzed to determine mercaptan conversion. The results from this test are presented in Table 1.

TABLE 1

Mercaptan Conversion Using a $NiO/MgO/Al_2O_3$ Solid Solution

| Hours on Stream | Mercaptan Conversion (%) |
|---|---|
| 8 | 100 |
| 16 | 100 |
| 20 | 100 |
| 24 | 100 |
| 28 | 99 |
| 32 | 100 |
| 36 | 100 |
| 40 | 100 |
| 44 | 100 |
| 48 | 100 |

EXAMPLE 3

Preparation of $NiO/Al_2O_3$ Solid Solution

A 2L, 3-necked round bottomed flask was equipped with a reflux condenser, a thermometer, and a mechanical stirrer. To this flask there was added a solution containing 412 g of water, 38 g of $Na_2CO_3 \bullet H_2O$ and 48.1 g of NaOH and the flask was cooled to <5° C. An addition funnel containing 228.4 g water, 100.12 g of $Ni(NO_3)_2 \bullet 6H_2O$ and 64.12 g $Al(NO_2)_3 \bullet 9H_2O$ was put in place of the reflux condensor and the solution added to the solution in the flask over a four (4) hour period while maintaining the temperature at <5° C. The resultant slurry was stirred for 1 hour at <5° C. after which the funnel was removed and the reflux condenser replaced. The flask was now placed in a Glass Col® heating mantle and was heated to 60° C. ±5° C. for 1 hour. The slurry was then cooled to room temperature, the solids recovered by filtration and washed with 10L of deionized water. These solids were then dried at 100° C. for 16 hours. After crushing the solid was calcined at 450° C. for 12 hours in a muffle furnace with air flow. X-ray diffraction analysis showed this product to be a solid solution of nickel and aluminum oxides. This sample was identified as sample B.

EXAMPLE 4

A reactor was loaded with 20 cc of sample B and heated to 38° C. Over this catalyst there was flowed FCC gasoline containing 7,000 ppm water and 290 ppm (as sulfur) of mercaptans at a liquid hourly space velocity of either 1.2 $hr^{-1}$ or 15 $hr^{-1}$. Air was injected to give a ratio of two times the stoichiometric amount required to oxidize the mercaptan to disulfide. The test was conducted for 180 hours during which time samples were withdrawn and analyzed to determine mercaptan conversion. The results from this test are presented in Table 2.

TABLE 2

Sweetening of FCC Gasoline Using a $NiO/Al_2O_3$ Solid Solution

| Hours on Stream | LHSV ($hr^{-1}$) | Mercaptan Conversion (%) |
|---|---|---|
| 4 | 1.2 | 97 |
| 8 | 1.2 | 99 |
| 24 | 1.2 | 100 |
| 36 | 15 | 99 |
| 44 | 15 | 99 |

TABLE 2-continued

Sweetening of FCC Gasoline Using a $NiO/Al_2O_3$ Solid Solution

| Hours on Stream | LHSV ($hr^{-1}$) | Mercaptan Conversion (%) |
|---|---|---|
| 64 | 15 | 100 |
| 92 | 15 | 99 |
| 112 | 15 | 99 |
| 136 | 15 | 99 |
| 148 | 15 | 99 |

EXAMPLE 5

A reactor was loaded with 10 cc of a $MgO/Al_2O_3$ solid solution with excess MgO obtained from Alcoa Industrial Chemicals and identified as Sorbplus TM. Over this catalyst there was flowed a FCC gasoline stream containing 77 ppm (as sulfur) of mercaptans and 7,000 ppm water at a liquid hourly space velocity of 1.2 $hr^{-1}$. Air was injected to give a ratio of two times the stoichiometric amount required to oxidize the mercaptan to disulfide. The test was conducted for 24 hours during which time samples were withdrawn and analyzed to determine mercaptan conversion. The results from this test are presented in Table 3.

TABLE 3

Sweetening of FCC Gasoline Using an $MgO/Al_2O_3$ Solid Solution + MgO

| Hours on Stream | Mercaptan Conversion (%) |
|---|---|
| 4 | 94 |
| 8 | 99 |
| 12 | 96 |
| 16 | 99 |
| 20 | 97 |
| 24 | 99 |

EXAMPLE 6

In a container there were added 0.8 g of sample B and 50 grams of iso-octane containing 1,154 wppms of n-octanethiol. This mixture was stirred for a few minutes and then a sample was withdrawn to test for sulfur. The analysis showed that the iso-octane contained 356 wppm of mercaptan sulfur. This experiment shows that water is not essential for activity.

We claim as our invention:

1. A process for treating a sour hydrocarbon fraction containing mercaptans consisting of contacting the hydrocarbon fraction with a catalyst effective in oxidizing mercaptans in the presence of an oxidizing agent under treating conditions thereby oxidizing the mercaptans to disulfides, the catalyst characterized in that it comprises a solid solution having the formula $$M_a(II)M_b(III)O_{(a+b)}(OH)_b$$

where M(II) is at least one metal having a +2 oxidation state and selected from the group consisting of magnesium, nickel, zinc, copper, iron, cobalt, calcium and mixtures thereof, M(III) is at least one metal having a +3 oxidation state and is selected from the group consisting of aluminum, chromium, gallium, scandium, iron, lanthanum, cerium, yttrium, boron and mixtures thereof, and the ratio of a:b is greater than 1 to about 15.

2. The process of claim 1 where the oxidizing agent is oxygen or air.

3. The process of claim 1 where the solid solution is a nickel oxide, magnesium oxide and aluminum oxide solid solution.

4. The process of claim 1 where the solid solution is a magnesium oxide and aluminum oxide solid solution.

5. The process of claim 1 where the catalyst contains a secondary component selected from the group consisting of calcium oxide, magnesium oxide, calcium hydroxide, magnesium hydroxide and mixtures thereof.

6. The process of claim 5 where the secondary component is magnesium oxide.

7. The process of claim 5 were the secondary component is present from about 0.1 to about 50 weight percent of the catalyst.

8. The process of claim 1 further characterized in that a polar compound is added to the sour hydrocarbon fraction.

9. The process of claim 8 where the polar compound is water and is present in an amount from about 10 ppm to about 15,000 ppm based on hydrocarbon.

* * * * *